US005870646A

United States Patent [19]

Simon

[11] Patent Number: 5,870,646

[45] Date of Patent: Feb. 9, 1999

[54] APPARATUS FOR DEVELOPING PHOTOGRAPHIC MATERIAL

[75] Inventor: Joachim Simon, Erkrath, Germany

[73] Assignee: Gretag Imaging AG, Regensdorf, Switzerland

[21] Appl. No.: 926,480

[22] Filed: Sep. 10, 1997

[30] Foreign Application Priority Data

Sep. 13, 1996 [EP] European Pat. Off. ..... 96810611

[51] Int. Cl.[6] ..... G03D 3/02; G03D 3/08

[52] U.S. Cl. ..... 396/617; 396/626; 396/636

[58] Field of Search ..... 396/612, 617, 396/620, 622, 626, 636, 645

[56] References Cited

U.S. PATENT DOCUMENTS

| | | | |
|---|---|---|---|
| 4,577,951 | 3/1986 | Takahashi et al. . | |
| 4,708,453 | 11/1987 | Fryda et al. | 396/617 |
| 4,837,593 | 6/1989 | Hehn | 396/622 |
| 5,179,404 | 1/1993 | Bartell et al. . | |
| 5,270,762 | 12/1993 | Rosenburgh et al. . | |
| 5,309,191 | 5/1994 | Bartell et al. . | |
| 5,311,235 | 5/1994 | Piccinino, Jr. et al. . | |
| 5,387,499 | 2/1995 | Earle et al. | 396/626 |

FOREIGN PATENT DOCUMENTS 0 623 849A1 11/1994 European Pat. Off. .

35 36 862A1 4/1987 Germany .

*Primary Examiner*—A. A. Mathews

*Attorney, Agent, or Firm*—Burns, Doane, Swecker & Mathis, LLP

[57] ABSTRACT

An apparatus for developing photographic material having a delivery device and a removal device for developing fluid as well as an inlet and an outlet for the material to be developed with a narrow conduit that extends from the inlet to the outlet. A transport mechanism for transporting the photographic material to be developed from the inlet through the conduit to the outlet wherein the material to be developed comes into contact with the developing fluid as it is transported through the conduit and is developed. Two half shells are connectable to one another, with each half shell having two plates joined to make the half shell. The apparatus also has a central positive displacement element, which together with the inner wall of the half shells, defines the conduit in which the photographic material is developed. The conduit extends between the positive displacement element and the respective inner wall of the half shell. The inner wall of the positive displacement element is embodied substantially as a flat face, while the outer wall reinforces the inner wall in order to prevent deformation of the inner wall by the high pressure of the developing fluid.

8 Claims, 7 Drawing Sheets

APPARATUS FOR DEVELOPING PHOTOGRAPHIC MATERIAL

BACKGROUND OF THE INVENTION

1. Field of the Invention

The invention relates to an apparatus for developing photographic material.

2. State of the Art

During the processing of customer orders in photographic developing or processing laboratories, exposed film is developed by wet chemical methods. The exposed film is typically in the form of a negative. The developed negatives are then copied or printed by being projected onto photographic print material. This material is often photographic paper. The exposed photographic paper is also developed by wet chemical methods. If the photo paper is in the form of a long strip, as is the case in high-capacity labs, it is partitioned into individual pictures. These partitioned pictures of the customer order are put together and packaged for return to the customer.

The apparatuses that contain the baths for the wet chemical development are known as film or paper processors. The volume of such wet chemical baths in the processors depends substantially on what throughput (number of developed pictures per unit of time) the particular user, usually the processing lab, seeks to achieve. For the sake of simplicity, only paper processors will be discussed hereinafter. For high throughput, the distance through the paper processor must be correspondingly long so that many pictures can be located in the paper processor simultaneously. By having continuous transport on one hand and a relatively high transport speed on the other, the passage time for the paper through the paper processor will match the length of time necessary for the development (which, of course, is predetermined). The result is a relatively large-volume baths and therefore, large-volume paper processors.

In order to avoid the large-volume baths, paper processors with small-volume baths have been proposed, for instance in U.S. Pat. Nos. 5,179,404, 5,270,762, 5,309,191 and 5,311,235. It is also important for the developing fluid in the baths to be "fresh" to ensure that the developed paper prints all have the same quality standard. As a consequence, the small-volume baths have to be changed or replenished periodically. Rapid motion of the wet chemical baths has proven to be beneficial. This motion results in fresh developing fluid repeatedly coming into contact with the paper to be developed. The complete replacement or replenishment of the baths must be performed more often in a small-volume bath than in larger-volume baths.

Small-volume baths and comparatively small-volume processors, as a rule, have a very narrow conduit. This conduit extends from the inlet through the interior of the processor to the outlet. The photo paper to be developed is transported along this conduit. During this transport, the photo paper comes into contact with the developing fluid and results in the paper being developed. The small volume of the conduit and the demand for constant circulation of the developing fluid leads to high pressure in the conduit.

In order to withstand this high pressure, the processors must be highly stable from a mechanical aspect while ensuring reliable operation. Paper jams should be eliminated; that is, reliable transport of the paper along the conduit must be assured. Moreover, the processors must be simple to manufacture and should be capable of being produced in an economical manner.

SUMMARY OF THE INVENTION

Exemplary embodiments of an apparatus of the present invention include two half shells that are connectable to one another. Each half shell has two plates joined together with one plate forming the outer wall of the half shell and the other forming the inner wall. The apparatus also includes a central positive displacement element, which, after being introduced into the connected half shells, together with the respective inner wall of the half shells defines the conduit in which the photographic material is developed. This conduit extends between the positive displacement element and the respective inner wall of the half shell. This inner wall of the half shell is embodied substantially as a flat face, while the outer wall has means for reinforcing the inner wall in order to prevent deformation of the inner wall by the high pressure of the developing fluid. Such apparatuses are highly stable mechanically. Furthermore, they are simple and economical to produce as well as being reliable in operation.

The means for reinforcing the inner wall of the half shell can be embodied as indentations in the plate forming the outer wall. These indentations point toward the inner wall and are connected on their respective contact area (e.g., contact face) to the plate forming the inner wall. As a result, high mechanical stability is achieved in a way that is simple from a production standpoint.

Another advantageous feature of an exemplary embodiment is characterized by the two half shells having the same shape. As a result, only one mold is needed to produce the half shells, which further reduces the expense of production. The half shells can be produced by the "twin sheet method". This method simplifies the production of the half shells.

Another feature of an exemplary embodiment of the invention pertains to the aspect where the positive displacement element is likewise formed of two half bodies connectable to one another. Each half body itself has two plates joined together to form the half body. They are joined in such a way that one plate forms the outer wall of the half body and the other forms the inner wall. The outer wall of the half body is embodied essentially as a flat face while the inner wall has means for reinforcing the outer wall in order to prevent deformation of the outer wall by the high pressure of the developing fluid. This embodiment of the positive displacement element likewise assures high mechanical stability. Similarly, the positive displacement elements are simple to produce and assure high operational reliability.

In a further feature of such an apparatus, the means for reinforcing the outer wall of the half body are embodied as indentations in the plate forming the inner wall. These indentations point towards the outer wall. The indentations of the plate forming the inner wall are connected on their respective contact face to the plate forming the outer wall.

In an exemplary embodiment, the two half bodies have the same shape, which facilitates the production of the half bodies since only a single mold is needed. An apparatus in which the half bodies are produced by the twin sheet method can be used, since this method enables the simple production of half bodies from a technical point of view.

BRIEF DESCRIPTION OF THE DRAWINGS

The present invention can be further understood with reference to the following description and the appended drawings, wherein like elements are provided with the same reference numerals. In the drawings.

DETAILED DESCRIPTION OF THE PREFERRED EMBODIMENTS

Figure 1:
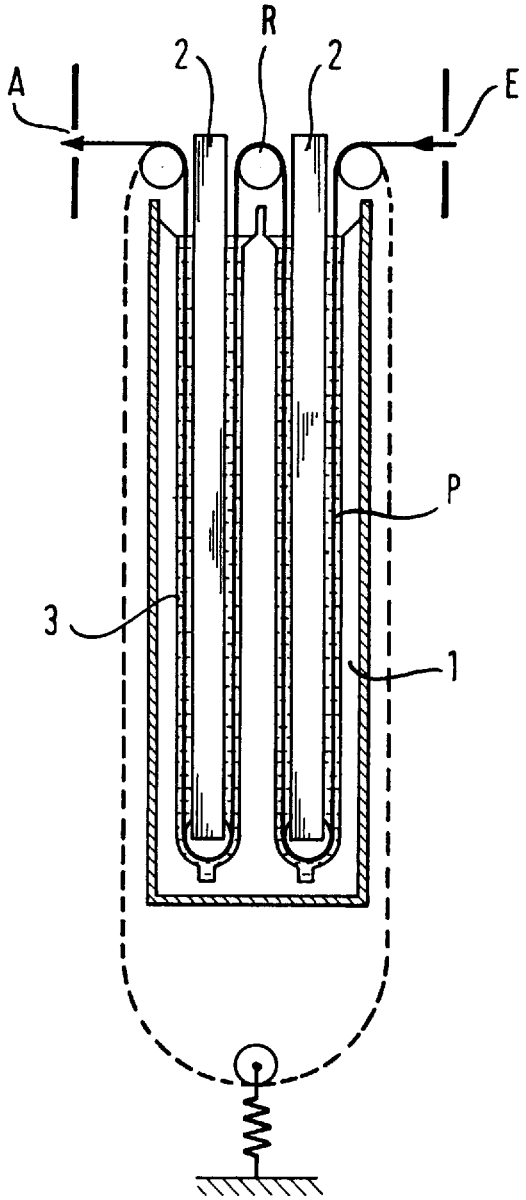
FIG. 1 illustrates the basic layout of a processor with a small volume developing fluid bath.

FIG. 1 is intended merely to illustrate the basic functional principles of a small volume developing fluid bath and some characteristics of the apparatus which would be apparent to those skilled in the art are not shown.

A tank 1 into which two racks 2 are introduced can be seen in FIG. 1. A narrow conduit 3 is defined between the inner wall of the tank 1 and the outer wall of the rack 2. The material to be developed, photo paper P in the case of a paper processor, is transported through this conduit and developed by contact with the developing fluid. The photo paper in FIG. 1 is in the form of a long strip as is typical in high capacity labs. It is transported through an inlet E, with the aid of the driveable rollers R that also tense the strip of paper, and through the conduit 3 to the outlet A. As seen clearly, the developing fluid bath in such processors has a smaller volume than in conventional processors. Nearly the entire interior of a conventional processor is filled with developing fluid and accordingly, the developing fluid bath has a large volume in these processors.

Figure 2:
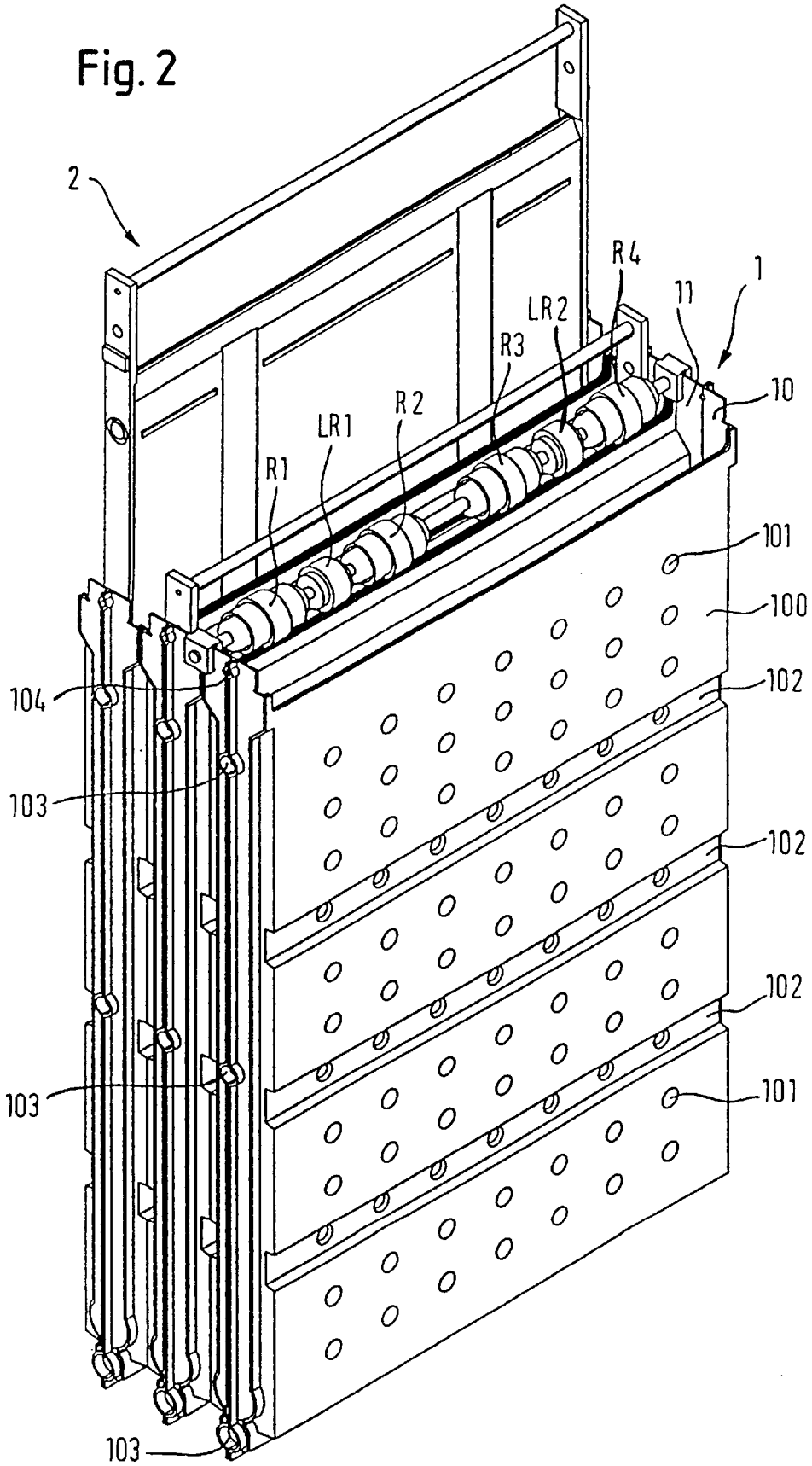
FIG. 2 is a perspective illustration of an exemplary embodiment of the apparatus of the present invention.

In FIG. 2 as well, some details which are not clearly apparent will be clarified by the following detailed explanation. With reference to FIG. 2, three tanks 1 are connected in series. Between two adjacent tanks, transport rollers R1, R2, R3 and R4 for four strips of photo paper are arranged. An additional roller LR1 for a first—continuously revolving—leader strip (not shown) is disposed between the transport rollers R1 and R2, and an additional roller LR2 for a second leader strip (not shown) is disposed between the transport rollers R3 and R4. The rollers R1, R2, R3 and R4 for the photo paper, disposed between two sequentially connected tanks 1, and the rollers LR1 and LR2 for the leader strip can be driven by means of a conventional chain drive (not shown).

For threading in the photo paper, the strips of photo paper (not shown) guided via the transport rollers R1 and R2 are each secured with a clamp to the leader strip guided via the roller LR1. The clamp is stripped off again after the photo paper has been threaded in. The same applies to the strips of photo paper guided via the transport rollers R3 and R4. In the region of the tank 1, the leader strip has practically the same course as the photo paper P, but parallel to it. Outside the tank, the leader strip is looped back again, as indicated by dashed lines in FIG. 1. In operation, the leader strip runs as an endless strip through the tank 1 and back around outside it and in again. The strip of photo paper P after passing through the tank 1 is not returned to the tank.

A positive displacement element, rack 2, is introduced into the tank 1 (as already explained in conjunction with FIG. 1). Rack 2 has not yet been introduced into the front tank in FIG. 2. In the middle tank, it is shown in position. In the rear tank, it is shown with a portion pulled out.

The front tank includes two half shells 10 and 11, which are joined, or linked together, to form the tank 1. A plurality of indentations 101 are distributed over the entire outer wall 100 of the half shell 10. These indentations 101 serve to provide higher mechanical stability of the half shell 10. A detailed description will follow.

There are three crosswise-extending indentations 102, into which securing elements (such as rail-like elements) can be introduced that extend around the entire processor (more or less embracing the processor). These hold the processor firmly together and thereby increase its mechanical stability still further. The face end of the half shells 10 and 11 contain three connection stubs 103 for the delivery or removal of developing fluid. The upper end of the face end includes a tube 104 through which a securing element, which fixes the rack 2 in the tank 1, can be passed once the rack 2 has been introduced into the tank 1.

Figure 3:
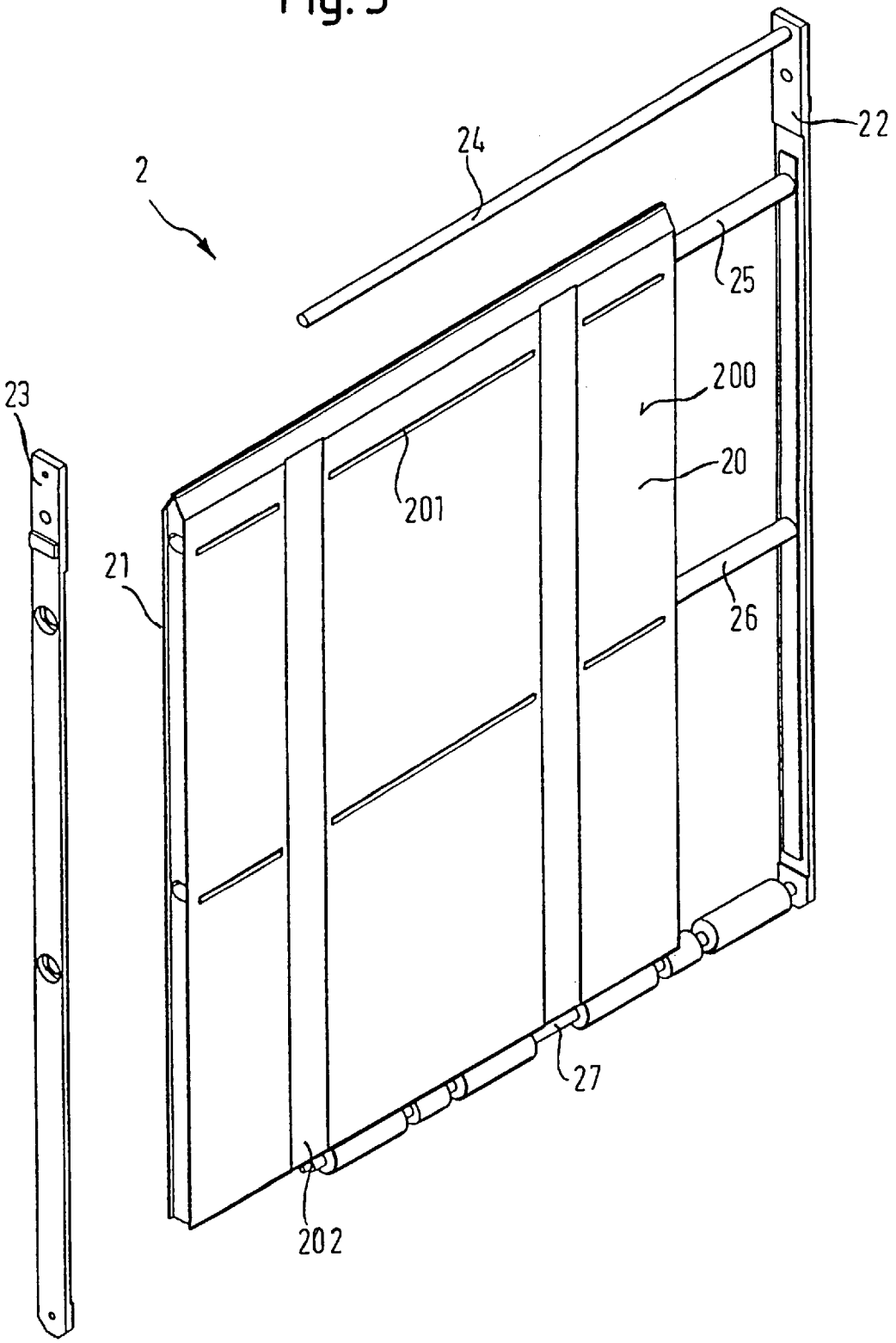
FIG. 3 illustrates an exemplary embodiment of the positive displacement element of the apparatus of the invention in a not-fully assembled state.

With reference to FIG. 3, rack 2 has two side struts 22 and 23, as well as a plurality of rods or tubes 24, 25, 26 and 27 that join the side struts 22 and 23. The rollers for the strips of photo paper and for the respective leader strip are provided on the lower rod 27. They are rotatably supported on this rod 27. When the rack is assembled, the positive displacement body, including two half bodies 20 and 21 (not visible in FIG. 3), is thrust over the rods 25 and 26. The side strut 23 is then firmly joined to the rods 24 and 27.

The positive displacement body that includes the two half bodies 20 and 21 has a plurality of slits 201 on its outer wall 200. The slits 201 allow the developing fluid to act upon the photo paper as if the fluid was flowing through a nozzle from the interior of the positive displacement body through these slits. On one hand, this eliminates the adhesion of the photo paper to the positive displacement body and on the other, promotes good circulation of the developing fluid. The photo paper to be developed is guided into these slits. Wherever the leader strip is guided, only a small indentation 202 extending longitudinally is provided, but it is closed, as the leader strip need not be acted upon by the developing fluid. The delivery of developing fluid into the interior of the positive displacement body and to the slits 201 can be performed in such a way that the rods 25 and 26 are embodied as hollow-cylindrical tubes that have flow openings at least in the region of the slits.

Figure 4:
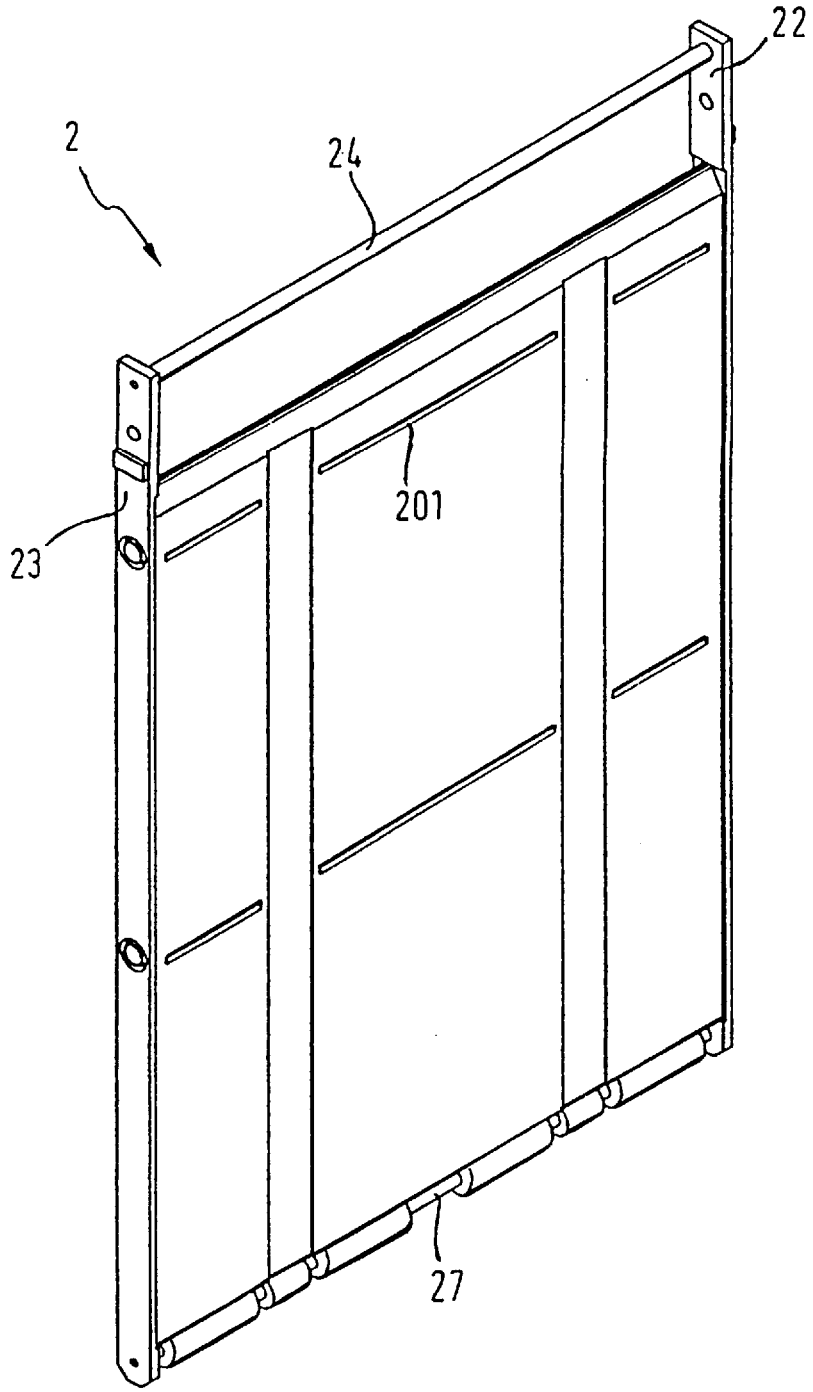
FIG. 4 illustrates the exemplary embodiment of the positive displacement element of FIG. 3 in an assembled state.

With reference to FIG. 4, a positive displacement element or rack 2 is shown in the assembled state. If the assembled rack 2 is now placed in the assembled tank 1, the result is practically an apparatus as shown in FIG. 2, especially in the middle part, which is already shown in the assembled state in FIG. 2.

An exemplary method for producing both the half shells 10 and 11 of the tank 1 and the half bodies 20 and 21 of the positive displacement element or rack 2 is the twin sheet method. As the name implies, they are embodied with double walls and are made from two plastic plates. The appearance in terms of the design of the individual half shells 10 and 11 and half bodies 20 and 21 will be described in more detail hereinafter. First, the basic mode of operation of the twin sheet method will be explained briefly with reference to FIGS. 5 and 6.

Two preheated thermoplastic plates P1 and P2 are placed between the mold halves F1 and F2 (FIG. 5) and heated from outside until they are thoroughly plasticized. The mold halves F1 and F2 are then driven together. The plasticized plates P1 and P2 are vacuum-deep-drawn in one step using a vacuum NP, and at the same time are welded together firmly at the edges (FIG. 6). Where particular accuracy of detail or dimensional accuracy is necessary, it is possible for instance (as indicated in FIG. 6) to generate an overpressure between the plates P1 and P2 by means of a narrow needle jet NJ through which compressed air PP is delivered. This compressed air PP, in addition to the suction exerted from outside by the vacuum NP, presses the plates against the mold halves F1 and F2. By this process, a high accuracy of detail is achieved. When the twin sheet method is employed, the otherwise typical subsequent joining together of the two parts is unnecessary. As a result, solvents, welding additives and other such materials are not needed. Any material protruding at the edge can be removed mechanically such as by chamfering.

Figure 5:
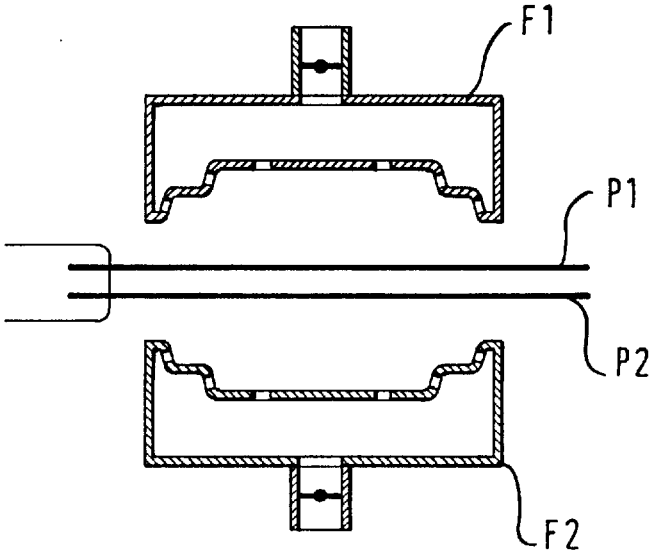
FIGS. 5 and 6 illustrate the basic mode of operation of the twin sheet method.
Figure 6:
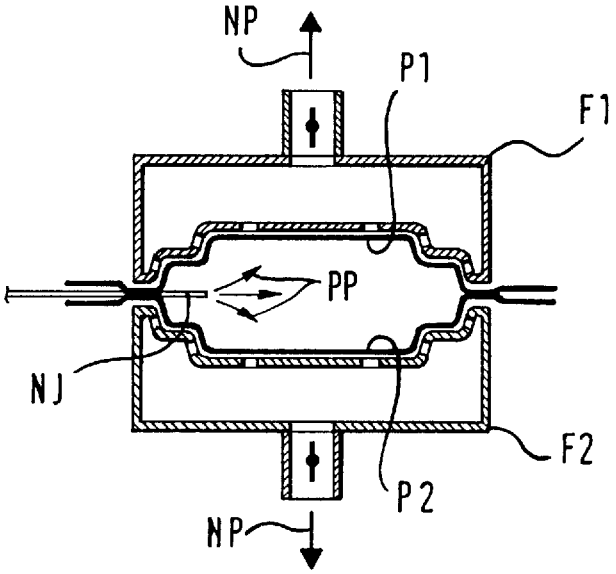

With the aid of FIGS. 5 and 6, the production of a hollow body has been described. This method can also be used to produce both the half shells 10 and 11 of the tank 1 as well as the half bodies 20 and 21 of the positive displacement element or rack 2. In an exemplary embodiment, the two half shells 10 and 11 of the tank 1 and the two half bodies 20 and 21 of the rack 2 can all have the same form. In this case, only one mold is needed to produce the tank 1 and the positive displacement element.

Figure 7:
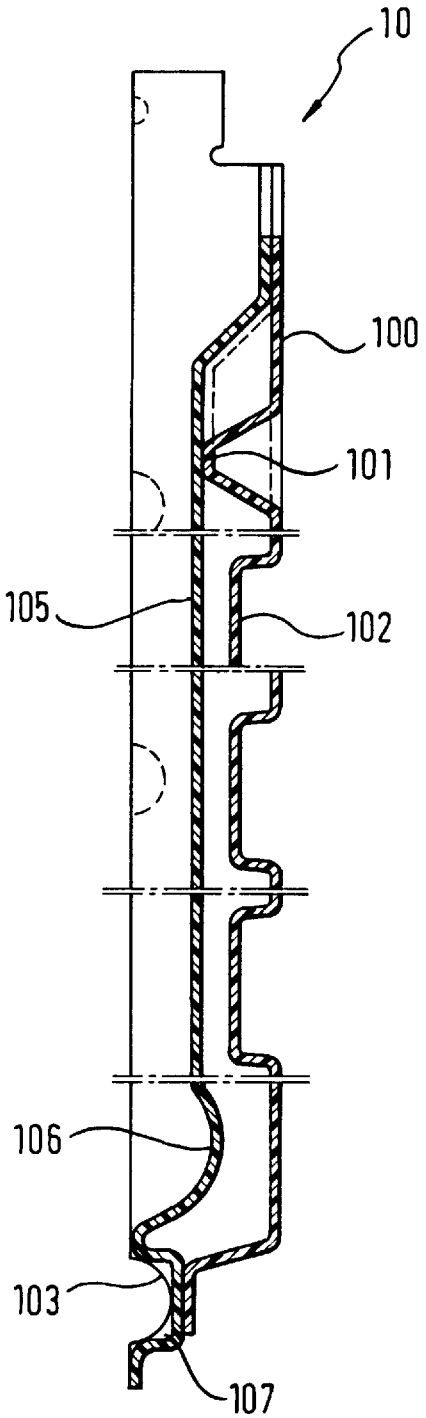
FIG. 7 illustrates, in section, a half shell of the tank of an exemplary embodiment of the apparatus of the invention.

With reference to FIG. 7, a cross section of a half shell 10 of the tank 1 is shown. In order to make the drawing simpler, it is shown with several interruptions. It can be seen that the half shell 10 is made from two plates. The outer wall 100 of the half shell 10 is formed by a plate that has a plurality of indentations 101 (see also FIG. 2). The inner wall 105 is also formed by a plate. The indentations 101 point toward the inner wall 105 and are joined at their contact face to the plate forming the inner wall 100. The indentations 101 accordingly act as a means for reinforcing the plate forming the inner wall 105, and increases the mechanical stability. The crosswise-extending indentations 102 (see also FIG. 2) can receive additional securing elements that encompass the entire processor.

Returning to FIG. 7, the inner wall 105 is embodied substantially as a flat face. However, this flat face can be structured; that is, it has a structure on its surface that makes it more difficult for the photo paper to adhere to this face. In the lower region, the otherwise substantially flat face nevertheless has a region 106 curved in the manner of a circular segment. It is in this region, after the rack 2 has been inserted into the tank 1, that the rollers provided on the lower end of the rack 2 for the strips of photo paper and for the leader strips are disposed. Below this region 106, there is a quasi-parallel piped region 107. This piped region opens out at the face end of the half shell 10 into the connection stub 103 (FIG. 2) through which the developing fluid is removed. Since both half shells 10 and 11 have the same shape, they are made with only a single mold. Once the two half shells 10 and 11 have been made, they are joined together and form the tank 1. The two half shells can be joined together by means of known methods, such as welding, adhesive bonding or other similar techniques.

Figure 8:
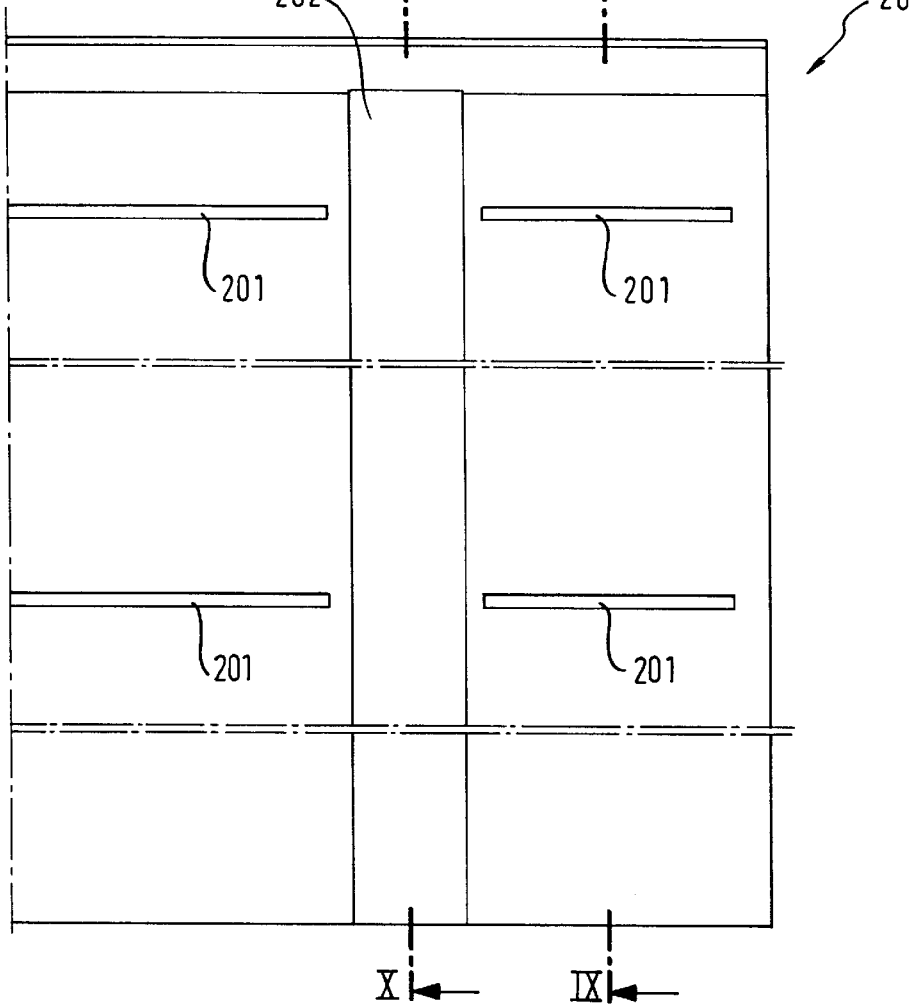
FIG. 8 illustrates the half of a half body of the positive displacement element of the rack of an exemplary embodiment of the apparatus of the invention.

In FIG. 8, one half of a half body of the positive displacement element or rack 2 can be seen in a front view. By way of example, this is the half body 20. In those regions in which the photo paper is guided, slits 201 are provided in the wall of the half body. Through these slits 201, developing fluid can be forced against the paper during operation as if being passed through a nozzle. As stated earlier, this counters adhesion of the paper to the positive displacement body while promoting circulation of the developing fluid. Such slits are consequently not provided in the longitudinally extending indentation 202 within which the leader strip passes. Also in FIG. 8, the positive displacement body 8 is shown interrupted, but it can be seen that the side toward the observer essentially forms a flat face. Once again, the flat face can be structured, which counteracts possible adhesion of the photo paper to this face.

Figure 10:
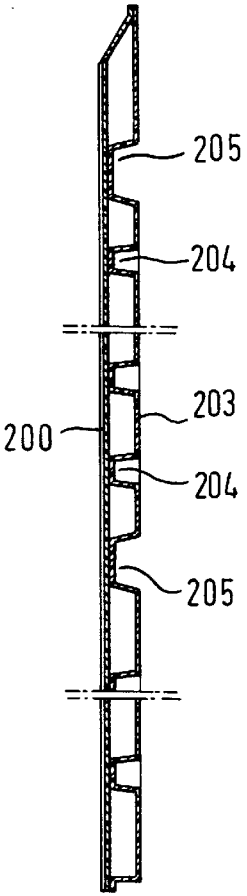
FIG. 10 illustrates a section through the half body taken along the line X—X of FIG. 8.
Figure 9:
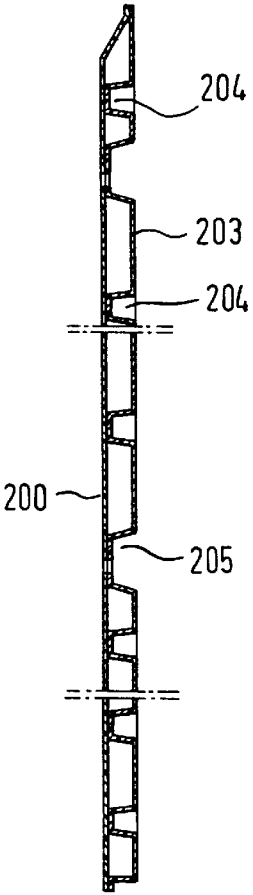
FIG. 9 illustrates a section through the half body taken along the line IX—IX of FIG. 8.

As mentioned above, the two half bodies 20 and 21 can be made using the twin sheet method already described. This can be seen clearly from FIG. 9 and FIG. 10, which show a section taken along the lines IX—IX and X—X, respectively, of FIG. 8. In FIG. 9, it can be seen that the plate of the half body 20 forming the outer wall 200 forms substantially a flat (preferably structured) face, which in operation is toward the photo paper. The plate forming the inner wall 203 is conversely provided with indentations 204, which extend as far as the outer wall 200 and which are joined at their contact face to the outer wall 200, similar to the half shells of the tank 1. Just as the indentations 101 (FIG. 2) increase the mechanical stability of the half shell 10, these indentations 204 increase the mechanical stability of the half body 20. Also visible in FIG. 9 and FIG. 10 on the inner wall 203 are two indentations 205 extending crosswise.

The two half bodies 20 and 21 can have the same shape, so that only one mold is needed for producing the half bodies. The two half bodies 20 and 21 are joined together by inner walls pointing toward one another using known methods such as welding or adhesive bonding. These half bodies form the positive displacement body of the rack 2. The crosswise-extending indentations 205 end up opposite each another in the process, so that the positive displacement body, after the two half bodies 20 and 21 have been joined, can be thrust onto the rods 25 and 26 (FIG. 3) to complete the rack. As mentioned earlier, the rods 25 and 26 (FIG. 3), as hollow- cylindrical tubes, can be provided with suitable flow openings, so that developing fluid can flow through the tubes and their flow openings and through the slits 201 in the positive displacement body to the photo paper. The slits 201 are not present when the half bodies 20 and 21 are produced. They must be made in a separate work step, for instance by milling, either on the half bodies before they are joined together to make the positive displacement body or on the finished positive displacement body.

Once the two half shells 10 and 11 have been made and joined together to make the tank 1, the rack 2 is introduced into the tank 1. In high-capacity processing labs in particular, as a rule, a plurality of such apparatuses are disposed in series with one another, in the manner as indicated in FIG. 2. Three such apparatuses are illustrated in FIG. 2, disposed one after the other. However, there may also be more than three apparatuses, as is also the rule in high capacity labs.

It will be appreciated by those skilled in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description and all changes that come within the meaning and range and equivalence thereof are intended to be embraced therein.

What is claimed is:

1. An apparatus for developing photographic material comprising:

a delivery device for delivering developing fluid to said apparatus;

a removal device for removing developing fluid from said apparatus;

an inlet and an outlet through which photographic material to be developed enters and exits;

a conduit that extends from the inlet to the outlet;

transport means for transporting the photographic material to be developed from the inlet through the conduit to the outlet, wherein the material to be developed comes into contact with the developing fluid as it is transported through the conduit;

two half shells connectable to one another, each half shell having two plates joined together, with one of said plates forming an outer wall of the half shell and the other of said plates forming an inner wall of the half shell; and a central positive displacement element which, after being introduced into the half shells which are linked with each other, defines together with the respective inner wall of the half shells the conduit for the photographic material to be developed, wherein the conduit extends between the positive displacement element and the respective inner wall of the half shell, and wherein the inner wall is embodied substantially as a flat face while the outer wall has a means for reinforcing the inner wall to prevent deformation of the inner wall by pressure of the developing fluid.

2. The apparatus of claim 1, wherein the means for reinforcing the inner wall of the half shell are formed as indentations in the plate forming the outer wall, said indentations pointing toward the inner wall and being connected at their respective contact area to the plate forming the inner wall.

3. The apparatus of claim 1, wherein both half shells have an identical shape.

4. The apparatus of claim 1, wherein the half shells are produced by a twin sheet method.

5. The apparatus of claim 1, wherein the positive displacement element is formed by two half bodies being connectable to each other, each half body comprising two plates joined together to form a half body, and consequently one of said plates forms an outer wall of said half body and the other of said plates forms an inner wall of the half body, the outer wall of the half body being embodied essentially as a flat face while the inner wall having means for reinforcing the outer wall to prevent deformation of the outer wall by high pressure of the developing fluid.

6. The apparatus of claim 5, wherein the means for reinforcing the outer wall of the half body are embodied as indentations of the plate forming the inner wall, said indentations pointing toward the outer wall and being connected at their respective contact area to the plate forming the outer wall.

7. The apparatus of claim 5, wherein said two half bodies of the positive displacement element have an identical shape.

8. The apparatus of claim 5, wherein said two half bodies are produced by a twin sheet method.

* * * * *